US007020982B2

(12) United States Patent
Park et al.

(10) Patent No.: US 7,020,982 B2
(45) Date of Patent: Apr. 4, 2006

(54) METHOD FOR CONTROLLING CLOTHES DRYER

(75) Inventors: Dae-Yun Park, Gyeonggi-Do (KR); Kyung-Seop Hong, Incheon (KR); Young-Hwan Park, Seoul (KR); In-Cheol Jeong, Gyeonggi-Do (KR); Soo-Young Oh, Seoul (KR); Si-Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/912,039

(22) Filed: Aug. 6, 2004

(65) Prior Publication Data

US 2005/0050758 A1 Mar. 10, 2005

(30) Foreign Application Priority Data

Aug. 12, 2003 (KR) ..... 10-2003-0055673

(51) Int. Cl.
*F26B 3/00* (2006.01)

(52) U.S. Cl. ..... 34/496; 34/493; 34/318; 34/527

(58) Field of Classification Search ..... 34/528, 34/527, 524, 318, 322, 493, 496
See application file for complete search history.

(56) References Cited

U.S. PATENT DOCUMENTS

| | | | | |
|---|---|---|---|---|
| 3,824,477 | A * | 7/1974 | Cotton | 327/509 |
| 3,864,844 | A * | 2/1975 | Heidtmann | 34/528 |
| 5,649,372 | A * | 7/1997 | Souza | 34/491 |
| 6,079,121 | A * | 6/2000 | Khadkikar et al. | 34/528 |
| 6,449,876 | B1 | 9/2002 | Pursell | |

* cited by examiner

*Primary Examiner*—Kenneth Rinehart
(74) *Attorney, Agent, or Firm*—Greenblum & Bernstein P.L.C.

(57) ABSTRACT

A method for controlling a clothes dryer is disclosed to precisely dry clothes on the basis of a load amount according to moisture contained in clothes in the clothes dry and a temperature change according to proceeding drying of clothes. The method includes: detecting a load amount detect signal corresponding to an amount of moisture contained in clothes in a drum; setting a heater exit temperature range of the clothes dryer to pre-set first and second temperature ranges on the basis of the load amount detect signal, and first drying clothes in the drum within the pre-set first temperature range; second-drying clothes in the drum within the pre-set second temperature range; and cooling clothes in the drum when the first and second-drying processes are completed.

7 Claims, 6 Drawing Sheets

METHOD FOR CONTROLLING CLOTHES DRYER

BACKGROUND OF THE INVENTION

1. Field of the Invention

The present invention relates to a clothes dryer and, more particularly, to a method for controlling a clothes dryer.

2. Description of the Background Art

In general, in a clothes dryer, an internal drum is rotated to rotate clothes in a drum, heat is generated by a heater, and at this time, low temperature little moisture air passes the heater to be changed to high temperature little moisture air according to rotation of a drying fan.

The clothes dryer heats the clothes by introducing the high temperature little moisture air into the drum. The high temperature little moisture air is changed to high temperature much moisture air by steam generated as the clothes are heated, and the high temperature much moisture air is condensed by an internal condenser to turn to a low temperature little moisture air with its moisture removed, and then, as the low temperature little moisture air passes the heater according to rotation of the drying fan, it is changed to high temperature little moisture air.

In other words, the clothes dryer dries clothes by repeatedly performing the process of introducing air into the drum and heating clothes.

When drying of the clothes is completed, the heater is stopped and only the motor is driven to cool clothes so that a user can easily draw clothes out from the drum.

In order to accurately dry clothes in the drum of the clothes dryer, the clothes dry completion point in the drum should be precisely detected. If the clothes dry completion point is not accurately detected, clothes can be damaged due to overdry or a fire can be broken out. Or, the clothes dry operation can be finished with clothes not fully dried yet due to underdry. Thus, the clothes dry completion point of the clothes dryer must be precisely detected.

In brief, in the conventional clothes dryer, clothes are dried in the drum, and a clothes dry completion point is detected on the basis of a change in a temperature of air discharged from the drum and a change in a temperature of air before being heated by the heater after being condensed in the condenser.

The operation of the conventional clothes dryer will be described with reference to FIG. 1 as follows.

FIG. 1 is a graph showing a change in a temperature of air discharged from an exit of the drum and a change in a temperature of an entrance of the heater before being heated by the heater after being discharged from the drum and condensed in the condenser in drying clothes in accordance with the conventional art.

As shown in FIG. 1, during a preheat-drying period, an initial drying period in drying clothes, thermal energy generated from the heater increases air, clothes and an ambient temperature so that moisture at the surface of clothes can be easily evaporated. During a constant rate period of drying where drying proceeds in full-scale, thermal energy is sued for evaporating moisture at the surface of clothes, so that a temperature distribution shows that a temperature of the circulated air is maintained constantly without a big change.

During a falling rate period of drying at a later part of drying, there is little moisture in clothes and thus most thermal energy is used to increase a temperature of a cycle air itself, so that a temperature of the cycle air which has passed the drum is sharply increased.

In addition, since there is little moisture in the cycle air, condensing does not occur at the condenser and heat of condensation is not generated, and a temperature of the entrance of the heater after passing through the condenser is rather reduced. Namely, in the conventional clothes dryer, a dry completion point is determined on the basis of the change in the temperature of the exit of the drum and the change in the temperature of the entrance of the heater. For example, the cycle air temperature at the exit of the drum and the cycle air temperature at the entrance of the heater are detected, and then, if a detected temperature difference between the two cycle airs is not smaller than a predetermined temperature, it is determined that drying of clothes has been completed.

However, the conventional clothes dryer cannot precisely detect the clothes dry completion point with the temperature difference between two cycle airs, causing a problem that clothes can be overdried beyond it needs or clothes is underdried that a clothes drying operation is stopped even though clothes is not completely dried.

In addition, even after the point at which drying is completed, the heater is continuously heated only to increase the temperature of the cycle air itself, causing a problem that power is much wasted unnecessarily.

U.S. Pat. No. 6,449,876 issued Sep. 17, 2002 discloses detailed descriptions on the conventional clothes dryer.

SUMMARY OF THE INVENTION

Therefore, one object of the present invention is to provide a method for controlling a clothes dryer capable of precisely drying clothes on the basis of a load amount according to moisture contained in clothes in the clothes dry and a temperature change according to proceeding drying of clothes.

Another object of the present invention is to provide a method for controlling a clothes dryer capable of effectively drying clothes while reducing power dissipation of a clothes dryer.

To achieve these and other advantages and in accordance with the purpose of the present invention, as embodied and broadly described herein, there is provided a method for controlling a clothes dryer including: detecting a load amount detect signal corresponding to an amount of moisture contained in clothes in a drum; setting a heater exit temperature range of the clothes dryer to pre-set first and second temperature ranges on the basis of the load amount detect signal, and first drying clothes in the drum within the pre-set first temperature range; second-drying clothes in the drum within the pre-set second temperature range; and cooling clothes in the drum when the first and second-drying processes are completed.

To achieve the above objects, there is also provided a method for controlling a clothes dryer including: a step in which when a clothes dry command is inputted from a command input unit of a clothes dryer, a drum is rotated and a load amount detect signal corresponding to an amount of moisture contained in clothes in the drum is detected; a step in which a heat exit temperature range of the clothes dryer is set to pre-set first and second temperature ranges on the basis of the load amount detect signal and clothes in the drum is dried within the pre-set first temperature range; a step in which clothes in the drum is second-dried within the pre-set second temperature range; a step in which when the first-drying and second-drying are completed, a motor of the clothes dryer is driven until a temperature of an exit of the drum of the clothes dryer drops to below a pre-set temperature, to cool clothes, wherein the pre-set second temperature range is lower than the pre-set first temperature range.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A method for controlling a clothes dryer, in which a load amount detect signal corresponding to an amount of moisture contained in clothes in a drum of a clothes dryer is detected, a heater exit temperature range of the clothes dryer is set to first and second pre-set temperature ranges on the basis of the load amount detect signal, clothes in the drum is first-dried within the first pre-set temperature range, clothes in the drum is second-dried within the second pre-set temperature range, and when the first and second drying processes are completed, clothes in the drum is cooled, whereby clothes can be accurately dried and power dissipation of the clothes dryer can be reduced, in accordance with a preferred embodiment of the present invention will now be described with reference to FIGS. 2 to 8.

Figure 1:
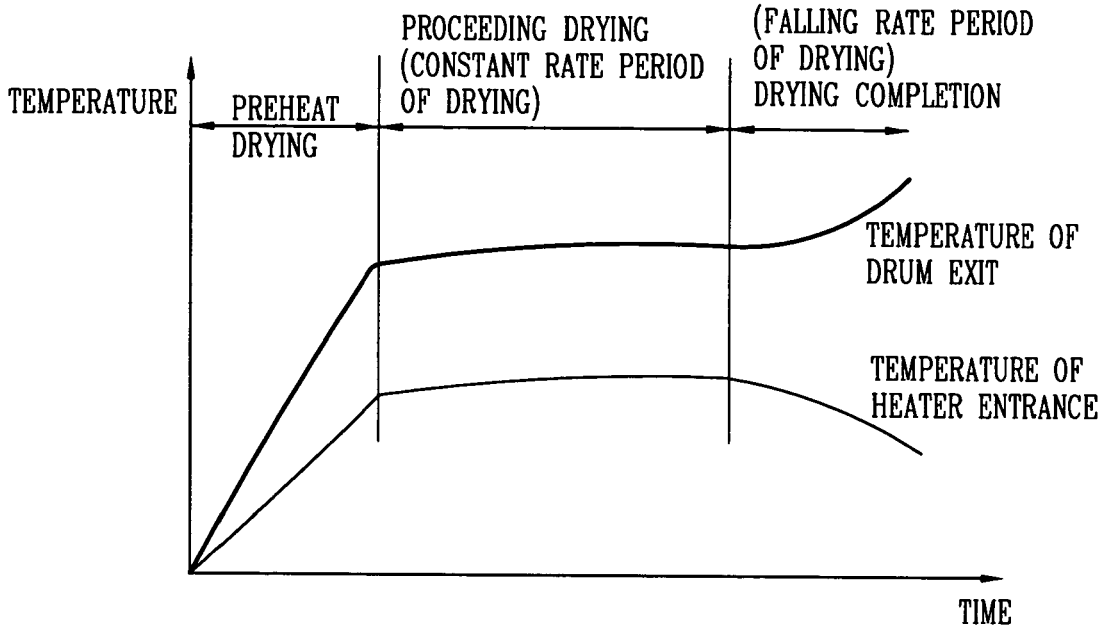
FIG. 1 PRIOR ART
FIG. 1 is a graph showing a change in a temperature of air discharged from an exit of the drum and a change in a temperature of an entrance of the heater before being heated by the heater after being discharged from the drum and condensed in the condenser in drying clothes in accordance with the conventional art.
Figure 2:
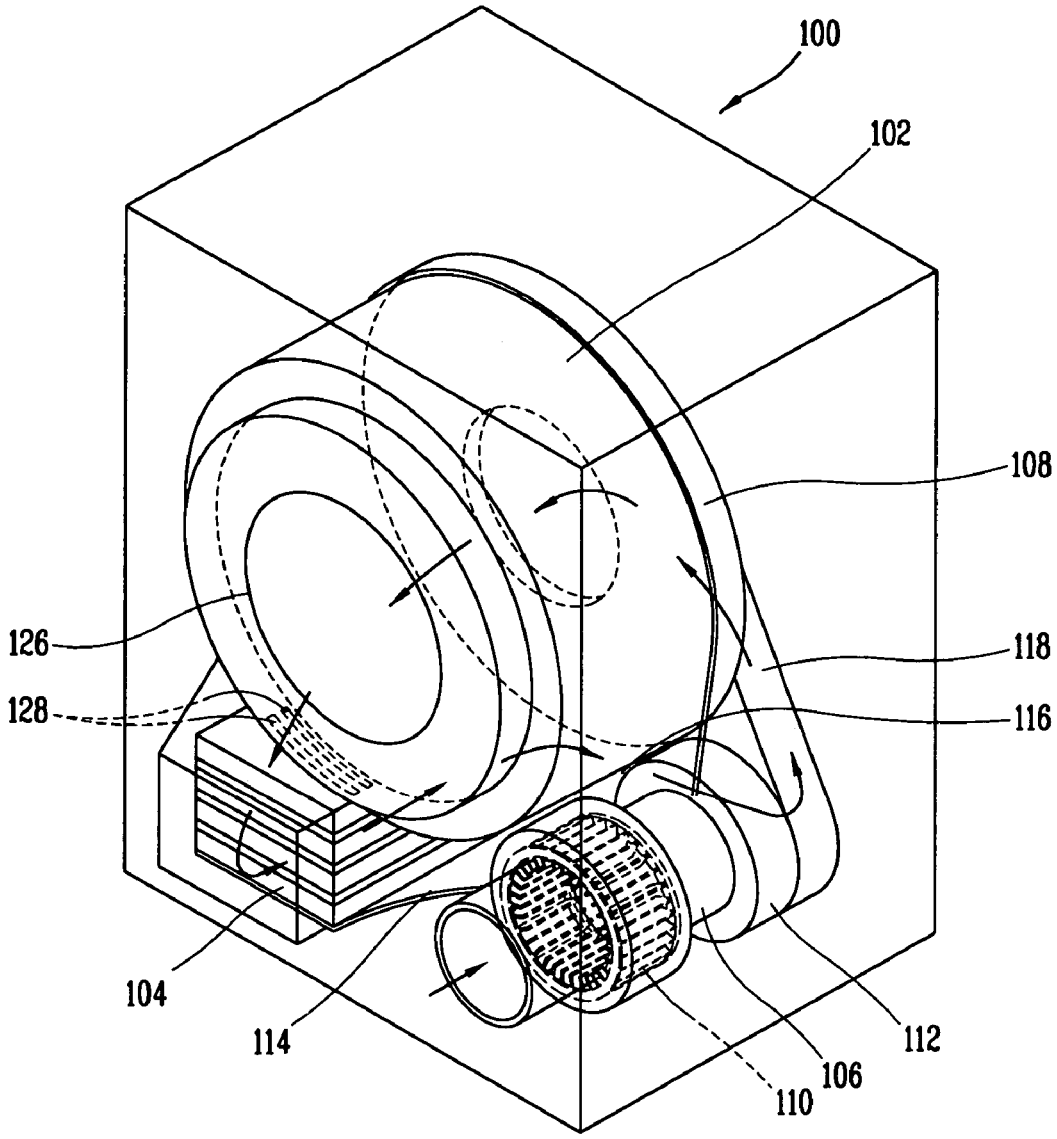
FIG. 2 is a perspective view showing the construction of the clothes dryer adopting a dry control method in accordance with the present invention.
Figure 3:
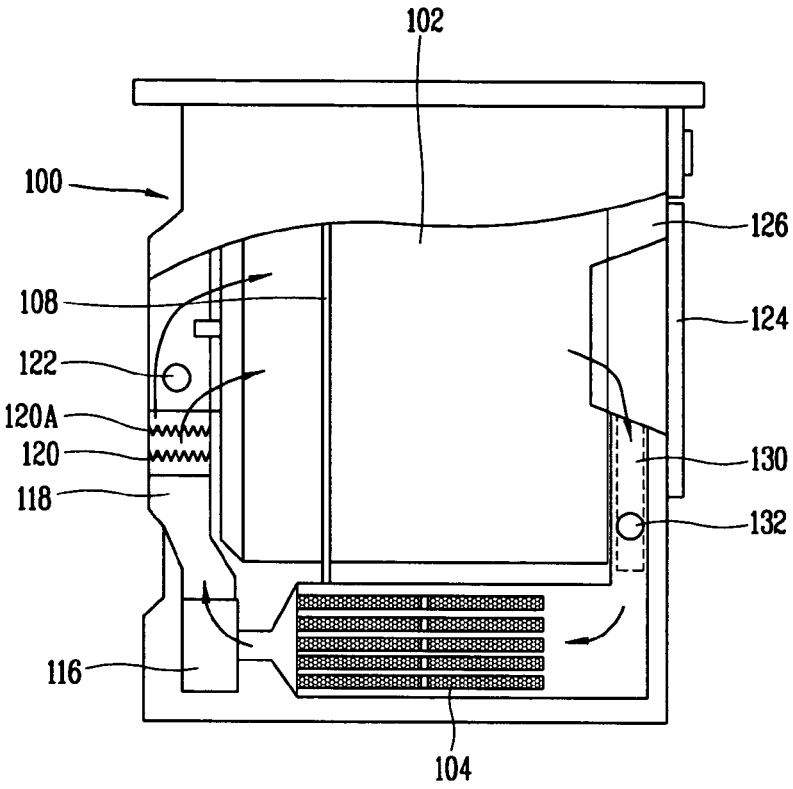
FIG. 3 is a side view showing the construction of the clothes dryer adopting a dry control method in accordance with the present invention.

FIG. 2 is a perspective view showing the construction of the clothes dryer adopting a dry control method in accordance with the present invention, and FIG. 3 is a side view showing the construction of the clothes dryer adopting a dry control method in accordance with the present invention.

As shown in FIGS. 2 and 3, the clothes dryer of the present invention includes a clothes dryer main body 100; a drum 102 installed in the main body 100 and receiving clothes to be dried; a condenser 104 installed at a right lower side of the drum 102; and a motor 106 installed at a left lower side of the drum 102. A pulley (not shown) is fixed at a rotational shaft of the motor 106, and since the pulley is connected to the drum 102 by a belt 108, so that as the motor 106 is driven, the drum 102 is rotated.

A cooling pan 110 and a drying pan 112 are installed at both left and right sides of the rotational shaft. An air passage 114 for inducing air blown by the cooling fan 110 to pass through the condenser 104 is installed between the cooling fan 110 and the condenser 104.

Air passages 116 and 118 for inducing air condensed in the condenser 104 to flow back into the drum 102 are respectively installed between the rear side of the condenser 104 and the drying fan 112 and between the drying fan 112 and the drum 102.

First heater 120 and second heater 120A for heating air are installed inside the air passage 118, and a first temperature sensor 122 for sensing a temperature of air heated in the first and second heaters 120 and 120A is installed at an upper side of the first and second heaters 120 and 120A. The first and second heaters 120 and 120A are different in power capacity. For instance, power dissipation of the first heater is about 2000 W while power dissipation of the second heater is about 800 W.

A door 124 is formed at a front side of the drum 120, and a drum cover 126 is formed at an inner side of the door 124 so as to be positioned at the front surface of the drum 102 when the door 124 is closed.

At a lower end of the drum cover 126, there are formed a load amount detecting sensor 128 made of a pair of electrodes is fixedly installed to detect a load amount of clothes to be dried (i.e., the amount of moisture contained in clothes to be dried), and an air passage 130 for inducing air discharged from the drum 102 toward the condenser 104. A second temperature sensor 132 for sensing a temperature of air discharged from the drum 102 is fixedly installed in the air passage 130.

The construction of the control unit of the clothes dryer in accordance with the present invention will now be described with reference to FIG. 4.

Figure 4:
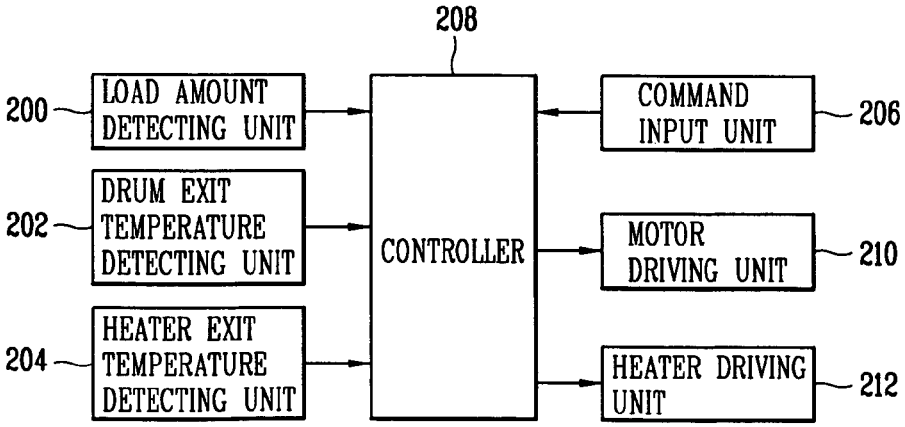
FIG. 4 is a block diagram showing the construction of a controlling unit of the clothes dryer adopting a dry control method in accordance with the present invention.

FIG. 4 is a block diagram showing the construction of a controlling unit of the clothes dryer adopting a dry control method in accordance with the present invention.

As shown in FIG. 4, the control unit of the clothes dryer in accordance with the present invention includes: a load amount detecting unit 200 for detecting a load amount (the amount of moisture) of clothes to be dried through the load amount detecting sensor 128; a drum exit temperature detecting unit 202 for detecting a temperature of air discharged from the drum 202 through the second temperature sensor 132; a heater exit temperature detecting unit 204 for detecting a temperature of air which has passed the first and second heaters 120 and 120A through the first temperature 122; a command input unit 206 for inputting an operation command according to user's manipulation; a controller 208 for controlling a clothes drying operation by determining the load amount of clothes to be dried on the basis of an output signal of the load amount detecting unit 200 according to an operation command inputted from the command input unit 206 and determining a drum exit temperature and a heater exit temperature on the basis of output signals of the drum exit temperature detecting unit 202 and the heater exit temperature detecting unit 204; a motor driving unit 210 for driving the motor 106 under the control of the controller 208; and a heater driving unit 212 for heating the first and second heaters 120 and 120A under the control of the controller 208.

The operation of the control unit of the clothes dryer of the present invention will now be described with reference to FIG. 4.

First, when a user puts clothes in the drum 102 and instructs a dry command by manipulating the command input unit 206, the controller 208 controls the motor driving unit 210 to drive the motor 106. Then, the drum 102 is rotated according to driving of the motor 106, and accordingly, wet clothes in the drum 102 is also rotated and contacts with the pair of electrodes of the load amount detecting sensor 128.

The pair of electrodes of the load amount detecting sensor 128 have a resistance value varied depending on the amount of moisture contained in the contacted clothes. Namely, the load amount detecting unit 200 generates a certain level of load amount detect signal corresponding to a resistance value of the load amount detect sensor 128 (i.e., a voltage corresponding to the resistance value), and outputs the generated load amount detect signal to the controller 208. Herein, the resistance value of the pair of electrodes is varied depending on the amount of moisture contained in clothes inside the drum 102. For example, if the amount of moisture contained in clothes inside the drum 102 increases, the resistance value of the pair of electrodes decreases, whereas if the amount of moisture contained in clothes inside the drum 102 decreases, the resistance value of the pair of electrodes increases. Namely, the resistance value of the pair of electrodes of the load amount detecting unit 200 is in inverse proportion to the amount of moisture contained in clothes inside the drum 102.

The controller 208 determines whether clothes inside the drum 102 is wet clothes or dried clothes on the basis of the load amount detect signal, and in case of the wet clothes, the controller 208 determines the load amount, namely, moisture contained in clothes, on the basis of a level of the load amount detect signal.

When the load amount is determined, the controller 208 sets pre-set initial conditions for drying clothes, controls the motor driving unit 210 to drive the motor 106 and controls the heat driving unit 212 to heat the first and second heaters 120 and 120A to thereby dry clothes.

Herein, when the motor 106 is driven, the drum 102 is rotated, the clothes to be dried is also rotated, and the cooling fan 110 and the drying fan 112 are also rotated. At this time, according to rotation of the cooling fan 110, external air is introduced, and the introduced air passes through the condenser 104 through the air passage 114, cooling the condenser 104.

Thereafter, as low temperature little moisture air introduced through the air passage 116 from the condenser 104 according to the drying fan 112 passes through the air passage 118, it changes to high temperature little moisture air due to heat generated by the first and second heaters 120 and 120A, which is then introduced into the drum 102, thereby heating and drying clothes.

Herein, high temperature much moisture air due to steam generated while clothes are being dried is introduced to a front side of the condenser 104 through the air passage 130 installed at the drum cover 126 and condensed, and low temperature little moisture air condensed in the condenser 104 and discharged backwardly is retrieved toward the drying fan 112 through the air passage 116. This circulation process is repeatedly performed to dry clothes.

The method for controlling clothes dryer in accordance with the present invention will now be described with reference to FIG. 5.

Figure 5A:
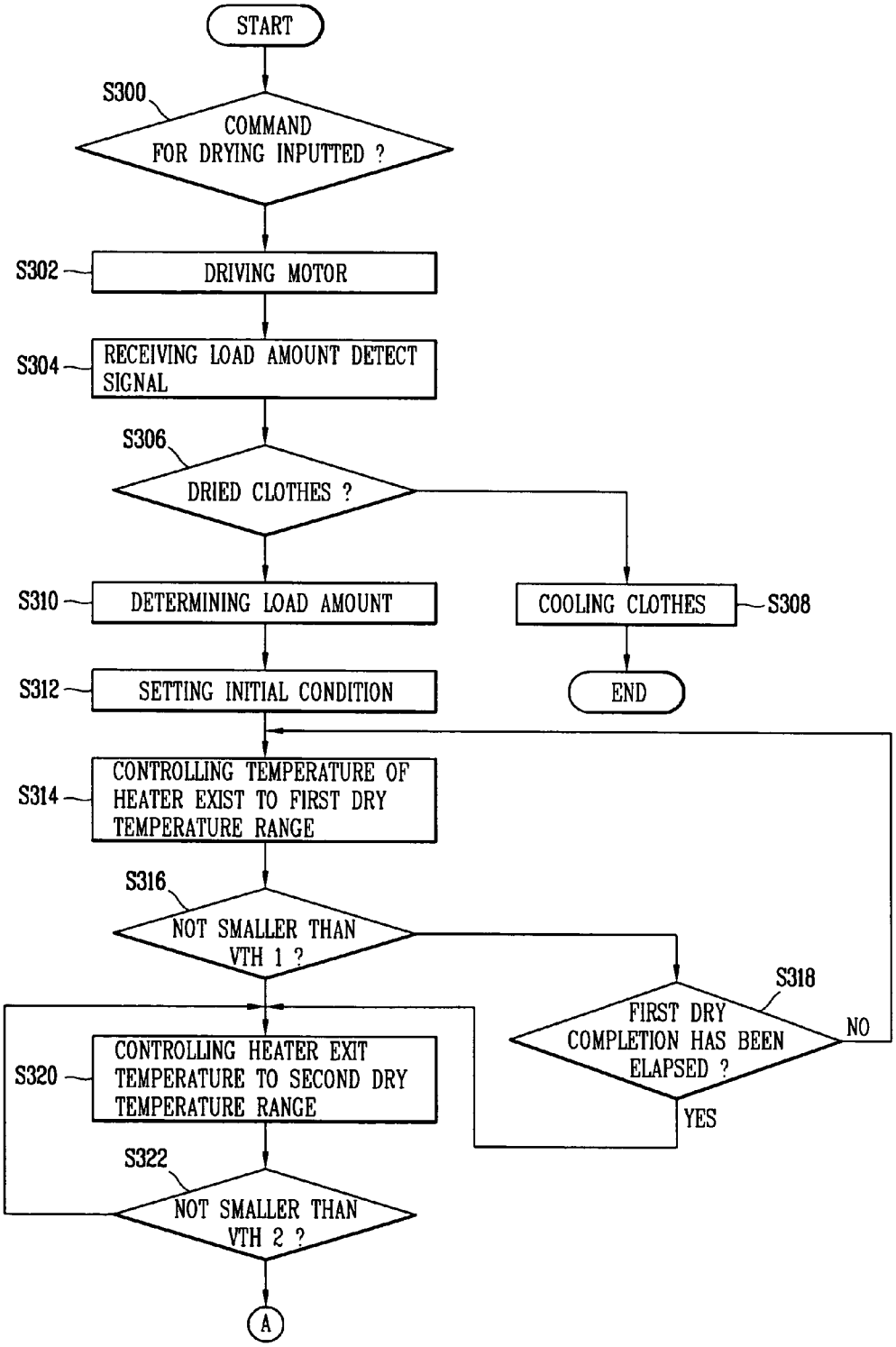
FIGS. 5A–5B are a flow chart of a method for controlling the clothes dryer in accordance with the present invention.
Figure 5B:
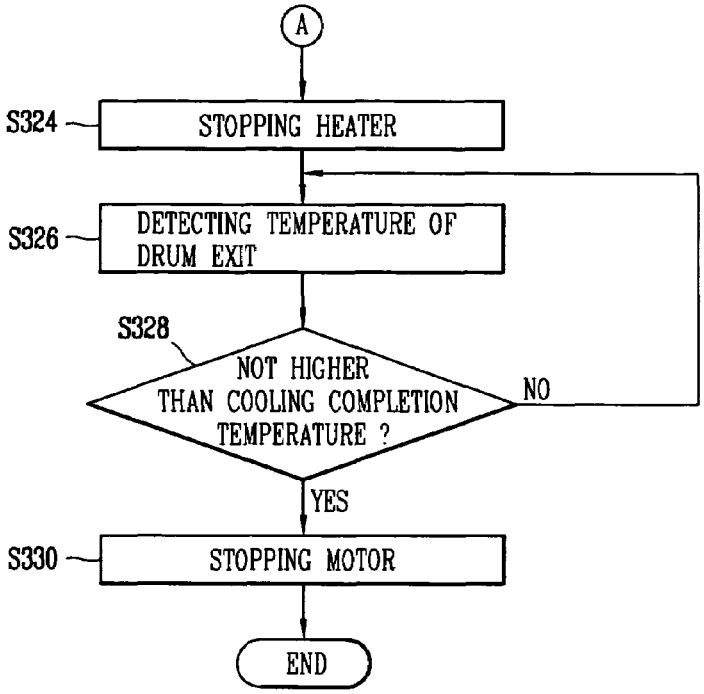

FIGS. 5A–5B are a flow chart of a method for controlling the clothes dryer in accordance with the present invention.

First, when a dry command is inputted from the command input unit 206 to the controller 208 (step S300), the controller 208 controls the motor driving unit 210 to drive the motor 106 (step S302) and receives a load amount detect signal generated from the load amount detecting unit 200 according to the amount of moisture contained in clothes contacting with the load amount detecting sensor 128 (step S304).

The controller 208 determines whether clothes in the drum 102 is dried clothes which does not need to be dried or not on the basis of the load amount detect signal (step S306), and if clothes in the drum 102 is dried clothes, the controller 208 drives the motor 106 for a predetermined time to cool the clothes and then, terminates the operation of the clothes dryer (step S308).

If, however, the clothes in the drum is not dried clothed according to determining in the step S306, the controller determines a load amount (the amount of moisture) of the clothes on the basis of a level of the load amount detect signal (step S310) and sets pre-set initial conditions (clothes dry conditions) according to the determined load amount (step S312). In this case, the controller 208 determines the amount of moisture of the clothes in the drum by comparing the load amount detect signal and a pre-set reference load amount signal through an experimentation.

A method for setting clothes dry conditions according to the load amount determined in the step S312 will now be described with reference to FIGS. 6 and 7.

Figure 6:
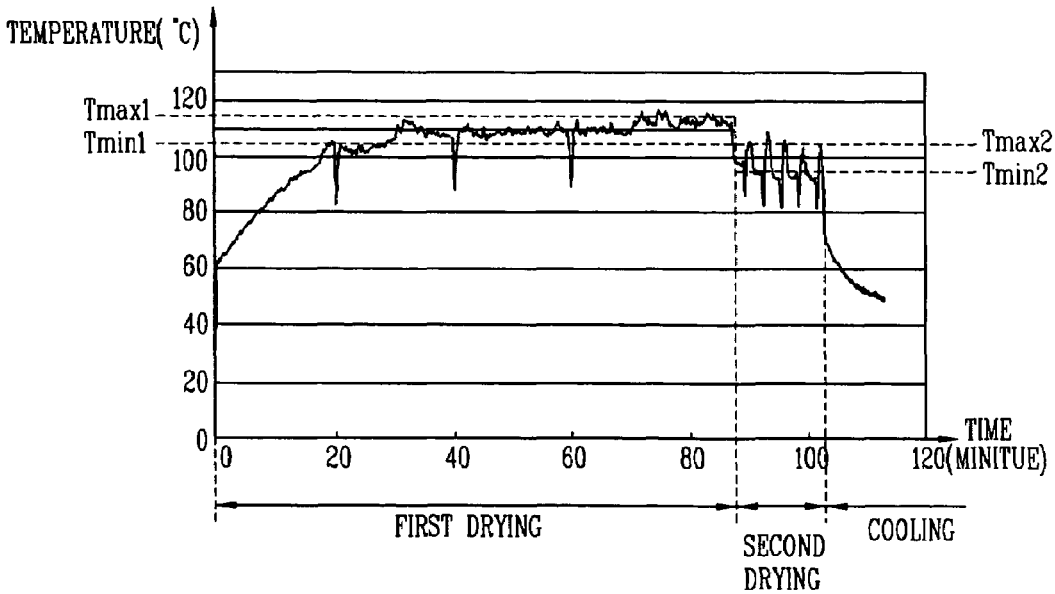
FIG. 6 is a graph showing a change in a temperature of a heater exit according to the dry control method in accordance with the present invention.
Figure 7:
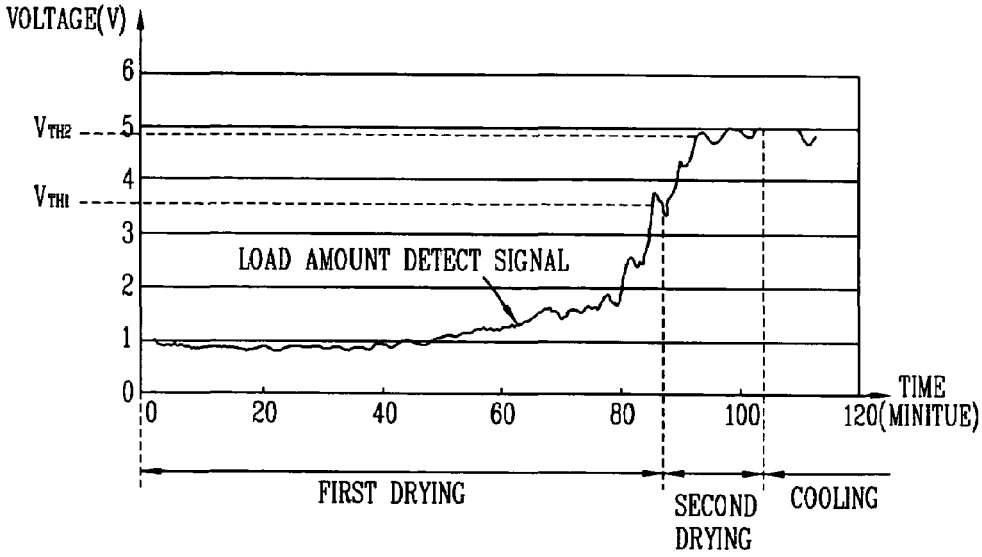
FIG. 7 is a graph showing a change in a load amount detect signal according to the dry control method in accordance with the present invention.

FIG. 6 is a graph showing a change in a temperature of a heater exit according to the dry control method in accordance with the present invention, and FIG. 7 is a graph showing a change in a load amount detect signal according to the dry control method in accordance with the present invention.

As shown in FIG. 6, a temperature range (Tmax1, Tmin1) of the heater exit during a first dry period, a temperature range (Tmax2, Tmin2) of the heater exit during a second dry period, first and second threshold voltages ($V_{TH1}$, $V_{TH2}$) for detecting first and second dry completion points on the basis of the load amount detect signal at the graph of FIG. 7, and a cooling completion temperature for cooling clothes at the graph of FIG. 6 after the first drying and the second drying are completed, are set, respectively, whereby clothes dry conditions according to the load amount determined in the step S312 is completed.

Herein, preferably, the temperature range (Tmax1, Tmin1) of the heater exit during the first clothes dry period is set to be higher than the range (Tmax2, Tmin2) of the heater exit during the second clothes dry period, and the temperature range (Tmax1, Tmin1) of the heater exit and the temperature range (Tmax2, Tmin2) of the heater exit when there is much load amount is set to be higher than the temperature range (Tmax1, Tmin1) and the temperature range (Tmax2, Tmin2) of the heater exit when there is a little load amount. The first threshold voltage VTH1 is set to be fixed to a certain level regardless of the load amount, and the second threshold voltage VTH2 is set to be high when there is much load amount and set to be low when there is a little load amount.

Thereafter, when the clothes dry conditions are completely set in the step S312, the controller 208 controls the heater driving unit 212 to heat the first heater 120 and, at the same time, controls the temperature of the heater exit detected by the heater exit temperature detecting unit 204 to the first dry temperature range (Tmax1~Tmin1) set in the clothes dry condition while controlling heating of the second heater 120A (step S314).

In other words, in the step (S314), the first heater 120 is continuously heated, while the second heater 120A having low heating value stops heating if the temperature of the heater exit detected by the heater exit temperature detecting unit 204 is not smaller than the maximum first dry temperature (Tmax1) and is heated if the temperature of the heater exit is not greater than the minimum first dry temperature (Tmin1). By repeatedly performing the heating operation, the temperature of the heater exit is controlled to be the first dry temperature range (Tmax1~Tmin1) set in the clothes dry condition.

Figure 8:
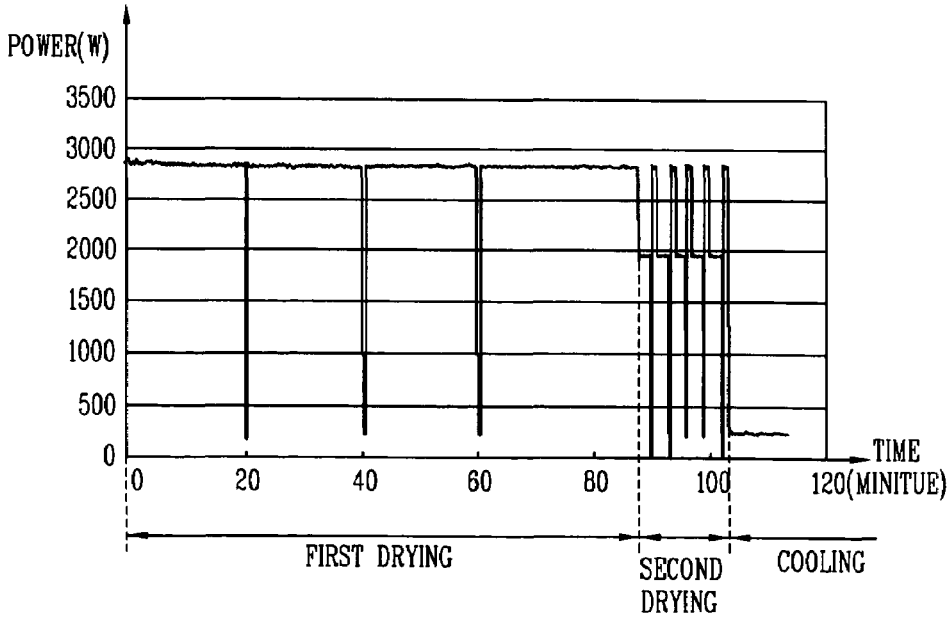
FIG. 8 is a graph showing a change in power supplied to a heater according to the dry control method in accordance with the present invention.

FIG. 8 is a graph showing a change in power supplied to a heater according to the dry control method in accordance with the present invention.

As shown in FIG. 8, a load amount detect signal generated by the load amount detecting unit 200 during the first dry period for drying clothes shows very small level change at an initial stage, and as clothes becomes dried and moisture is evaporated from clothes, a resistance value of the load amount detecting sensor 128 increases and the level of the load amount detect signal also increases.

Thereafter, the controller 208 determines whether the level of the load amount detect signal detected by the load amount detecting unit 200 is not smaller than the first threshold voltage ($V_{TH1}$) set in the clothes dry condition (step S316)

If the level of the load amount detect signal is not greater than the first threshold voltage ($V_{TH1}$) in the step S316, the controller 208 determines whether a pre-set first dry completion time has elapsed (step S318).

In addition, if the level of the load amount detect signal is not greater than the first threshold voltage ($V_{TH1}$) and at the same time the first dry completion time previously set in the step S318 has not elapsed, it returns to the step S314 and the controller continuously performs the operation of the first dry period while controlling the temperature of the heater exit to the first dry temperature range (Tmax1~Tmin1). Herein, the first dry completion time in the step S318 is to prevent a phenomenon that clothes being dried is overheated to be damaged or a fire is broken out.

In other words, when there is much load amount, even through the first drying is performed for a long time, the level of the load amount detect signal would not be increased to above the pre-set first threshold voltage (VTH1), and in this case, if the first drying is kept performing with high heat, the clothes could be damaged from overheat and a fire could be broken.

Therefore, in the present invention, a time taken for sufficiently drying clothes during the first dry period is set as a first dry completion time, and when the first dry completion time elapses, the first drying is terminated.

Meanwhile, if a level of the load amount detect signal is not smaller than the pre-set first threshold voltage (VTH1) in the step S316 or when the pre-set first dry completion time elapses, in the step S318, the controller 208 terminates the first drying operation.

After the first drying operation is terminated, the controller 208 controls the temperature range of the heater exit detected by the heater exit temperature detecting unit 204 to the second dry temperature range (Tmax2~Tmin2) previously set in the clothes dry condition (step S320). At this time, the controller 208 determines whether a level of the load amount detect signal detected by the load amount detecting unit 200 is not smaller than the second threshold voltage (VTH2) previously set in the clothes dry condition (step S322).

If a level of the load amount detect signal detected by the load amount detecting unit 200 is not greater than the second threshold voltage (VTH2), the controller 208 returns to the step S320 for controlling the temperature range of the heater exit to the second dry temperature range (Tmax2~Tmin2).

In other words, an over-dry phenomenon occurs during the second drying period so that most of thermal energy generated from the first and second heaters 120 and 120A increases the temperature of the circulated air itself.

Thus, in the present invention, the first heater 120 having high heat value is continuously heated, where the second heater 120A having low heat value is stopped heating when the temperature of the heater exit detected by the heater exit temperature detecting unit 204 is not smaller than the maximum second dry temperature (Tmax2), and then, when the temperature of the heater exit is not higher than the minimum second dry temperature (Tmin2), the second heater 120A is heated again, whereby the temperature of the heater exit is maintained within the second dry temperature range (Tmax2~Tmin2) which has been set to be lower than the first dry temperature range (Tmax1~Tmin1), thereby reducing power dissipation of the clothes dryer. Herein, clothes is quickly dried during the second dry period, so that a level of the load amount detect signal detected by the load amount detecting unit 200 rises fast.

Meanwhile, if the level of the load amount detect signal detected by the load amount detecting unit 200 is not smaller than the second threshold voltage (VTH2), the controller 208 controls the heater driving unit 212 to stop both the first and second heaters 120 and 120A, and terminates the second drying operation. At this time, the controller 208 cools clothes while continuously driving the motor 106 (step S324).

And then, the controller 208 detects a temperature of the drum exit through the drum exit temperature detecting unit 202 (step S326) and determines whether the temperature of the drum exit is not greater than a pre-set cooling completion temperature (step S328). Namely, the controller determines whether the temperature of the drum exit is a temperature (i.e., cooling completion temperature) suitable for a user to take dried clothes out of the drum 102. If the temperature of the drum exit is higher than the cooling completion temperature, the controller 208 returns to the step S326 and determines whether the temperature of the drum exit is not higher than the cooling completion temperature. When the temperature of the drum exit is not higher than the cooling completion temperature, the controller 208 stops the motor 106 and terminates the clothes drying operation (step S330).

As so far described, the method for controlling the clothes dryer of the present invention has the following advantages.

That is, for example, in drying clothes, a load amount is first determined, and the first drying process and the second drying process are performed within a pre-set temperature range according to the determined load amount. Thus, clothes can be accurately dried. In addition, at a point where clothes drying is almost completed, generation of heat that would increase a temperature of the cycle air is reduced and thus power dissipation can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for controlling a clothes dryer comprising:

rotating a drum and detecting a load amount detect signal corresponding to an amount of moisture contained in clothes in the drum when a clothes dry command is inputted from a command input unit of the clothes dryer;

setting a heat exit temperature range of the clothes dryer to pre-set first and second temperature ranges on the basis of the load amount detect signal;

first drying clothes in the drum within the pre-set first temperature range;

second drying the clothes in the drum within the pre-set second temperature range; and driving a motor of the clothes dryer when the first drying and second drying are completed, until a temperature of an exit of the drum of the clothes dryer drops to below a pre-set temperature, to cool the clothes, wherein the pre-set second temperature range is lower than the pre-set first temperature range, and wherein, in the first drying of the clothes, if a level of the load amount detect signal is not greater than a preset first threshold voltage and a pre-set first dry completion period has not elapsed, the clothes in the drum are dried in the pre-set first temperature range.

2. A method for controlling a clothes dryer comprising:

rotating a drum and detecting a load amount detect signal corresponding to an amount of moisture contained in clothes in the drum when a clothes dry command is inputted from a command input unit of the clothes dryer;

setting a heat exit temperature range of the clothes dryer to pre-set first and second temperature ranges on the basis of the load amount detect signal;

first drying clothes in the drum within the pre-set first temperature range;

second drying the clothes in the drum within the pre-set second temperature range; and driving a motor of the clothes dryer when the first drying and second drying are completed, until a temperature of an exit of the drum of the clothes dryer drops to below a pre-set temperature, to cool the clothes, wherein the pre-set second temperature range is lower than the pre-set first temperature range, and wherein, in the second drying of the clothes, if the level of the load amount detect signal is not smaller than the pre-set first threshold voltage, the clothes in the drum are dried in the pre-set second temperature range.

3. A method for controlling a clothes dryer comprising:

rotating a drum and detecting a load amount detect signal corresponding to an amount of moisture contained in clothes in the drum when a clothes dry command is inputted from a command input unit of the clothes dryer;

setting a heat exit temperature range of the clothes dryer to pre-set first and second temperature ranges on the basis of the load amount detect signal;

first drying clothes in the drum within the pre-set first temperature range;

second drying the clothes in the drum within the pre-set second temperature range; and driving a motor of the clothes dryer when the first drying and second drying are completed, until a temperature of an exit of the drum of the clothes dryer drops to below a pre-set temperature, to cool the clothes, wherein the pre-set second temperature range is lower than the pre-set first temperature range, and wherein, in the second drying of the clothes, if the level of the load amount detect signal is not smaller than the preset first threshold voltage and the pre-set first dry completion period has elapsed, the clothes in the drum are dried in the pre-set second temperature range.

4. The method of claim 3, wherein, in the cooling of the clothes, when the clothes in the drum are dried in the pre-set second temperature range, if the level of the load amount detect signal is not smaller than the pre-set second threshold voltage, the clothes in the drum are cooled, and the second threshold voltage is set to be higher than the first threshold voltage.

5. The method of claim 4, wherein the first threshold voltage is set to be fixed in advance regardless of the load amount detect signal, and the second threshold voltage is set to be flexible at above the first threshold voltage according to the amount of moisture contained in clothes in the drum.

6. A method for controlling a clothes dryer comprising:

rotating a drum and detecting a load amount detect signal corresponding to an amount of moisture contained in clothes in the drum when a clothes dry command is inputted from a command input unit of the clothes dryer;

setting a heat exit temperature range of the clothes dryer to pre-set first and second temperature ranges on the basis of the load amount detect signal;

first drying clothes in the drum within the pre-set first temperature range;

second drying the clothes in the drum within the pre-set second temperature range; and driving a motor of the clothes dryer when the first drying and second drying are completed, until a temperature of an exit of the drum of the clothes dryer drops to below a pre-set temperature, to cool the clothes, wherein the pre-set second temperature range is lower than the pre-set first temperature range, and wherein the second drying of the clothes in the drum is performed when a pre-set dry completion time elapses.

7. A method for controlling a clothes dryer comprising:

rotating a drum and detecting a load amount detect signal corresponding to an amount of moisture contained in clothes in the drum when a clothes dry command is inputted from a command input unit of the clothes dryer;

setting a heat exit temperature range of the clothes dryer to pre-set first and second temperature ranges on the basis of the load amount detect signal;

first drying clothes in the drum within the pre-set first temperature range;

second drying the clothes in the drum within the pre-set second temperature range; and driving a motor of the clothes dryer when the first drying and second drying are completed, until a temperature of an exit of the drum of the clothes dryer drops to below a pre-set temperature, to cool the clothes, wherein the pre-set second temperature range is lower than the pre-set first temperature range, and wherein the detecting the load amount detect signal comprises:

detecting a resistance value of a pair of electrodes which contacts with the clothes in the drum when the drum is rotated;

generating a voltage corresponding to the resistance value; and detecting the generated voltage, and wherein the amount of moisture contained in the clothes is inversely proportional to the resistance value.

* * * * *